United States Patent [19]

Huegy

[11] Patent Number: 4,901,483

[45] Date of Patent: Feb. 20, 1990

[54] SPIRAL HELIX TENSEGRITY DOME

[76] Inventor: Charles W. Huegy, 2 Mann St., Irvine, Calif. 92715

[21] Appl. No.: 248,340

[22] Filed: Sep. 20, 1988

Related U.S. Application Data

[63] Continuation-in-part of Ser. No. 891,401, May 2, 1986, abandoned, which is a continuation-in-part of Ser. No. 603,341, Apr. 16, 1984, abandoned.

[51] Int. Cl.[4] ..... E04B 1/32

[52] U.S. Cl. ..... 52/81; 52/DIG. 10

[58] Field of Search ..... 52/81, DIG. 10

[56] References Cited

U.S. PATENT DOCUMENTS

| | | | |
|---|---|---|---|
| 3,094,708 | 6/1963 | Caldwell | 52/81 |
| 3,257,930 | 6/1966 | Averna | 52/81 |
| 3,292,316 | 12/1966 | Zeinetz | 52/81 |
| 3,955,329 | 5/1976 | Hannula | 52/81 |
| 3,977,138 | 8/1976 | Chastain | 52/81 |
| 4,092,810 | 6/1978 | Sumner | 52/81 |
| 4,187,613 | 2/1980 | Ivers | 52/749 |
| 4,473,976 | 10/1984 | Kuznetsov | 52/83 |
| 4,651,993 | 3/1987 | Netsch | 446/86 |

OTHER PUBLICATIONS

Geodesics by Popko, pp. 47–48, 54 published 1968 by University of Detroit Press.

Domebook II, published by Pacific Domes, 1971, pp. 35–37.

*Primary Examiner*—John E. Murtagh

[57] ABSTRACT

A building of geodesic dome type based on a variant of the helix formula and exhibiting the engineering characteristic known as tensegrity. All juncture points are precisely located from the jig for construction. A method of top closure enabling easy construction is included.

5 Claims, 17 Drawing Sheets

SPIRAL HELIX TENSEGRITY DOME

This application is a continuation-in-part of U.S. application No. 891,401 filed May 2, 1986, and now abandoned which is in turn a continuation-in part of U.S. application No. 603,341 filled Apr. 16, 1984, and now abandoned.

CROSS REFERENCES

Construction of domes utilizing triangular arrangements of struts or plates is an old technique known generally as "geodesic". The prior art provides many examples of joining such struts or plates.

SUMMARY

The building is designed according to a precise mathematical formula from which all points of juncture for struts or plates may be readily determined. The formula is a variant of the helix formula and when it is applied in both a clockwise and counter clockwise manner to the surface of a sphere, ellipse, or such like shape, defines a polygonal grid on the surface. The counter-clockwise spirals from base to zenith are eccentric in that they do not proceed from base to zenith in the same number of degrees as the clockwise spirals. As a result of the eccentricity of the spirals an eccentric pattern of polygons emerges whereby connections of apices across the polygons do not yield symmetric triangles. When connections are made across the polygons in both directions: "horizontal" (that is parallel to the ground), and diagonal, the resultant pattern becomes "geodesic" and gains additional strength from the engineering principle of "tensegrity" which results.

By interrupting this pattern at specific points and making calculated adjustments, conventional shaped and sized apertures may be provided for doors or windows, or for panels allowing one or more structures to be easily conjoined.

The use of the spiral helix formula also enables the use of a simple building system that facilitates precise construction.

DESCRIPTION

Figure 1:
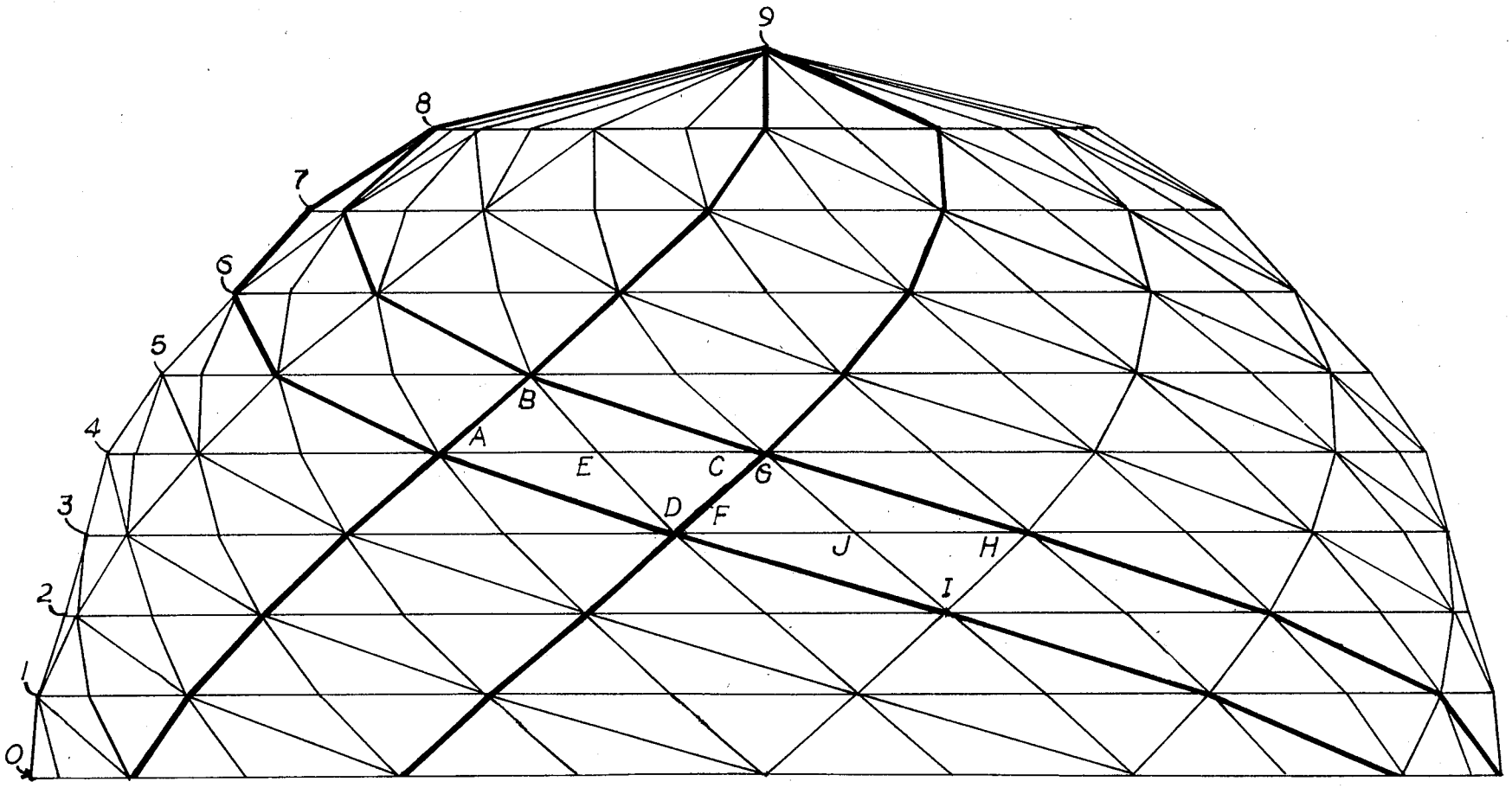
FIG. 1 is a side view of the dome.

A roughly spherical shape of the dome is shown in FIG. 1. The dome is designed according to a variant of the helix formula in one of its formats: $Z=a'\theta$, where Z is a height above the base of the dome; a' is a parameter and not a constant; $\theta$ is the angle formed by a vector from the center of the dome along the base of the dome to the perimeter of the base as it is rotated from its initial position in an ever widening arc. The helix formula in any one of its formats described above may be modified by the use of a series of numbers which increase in size in some regular manner. Each level of closure will be assigned a number from the series to represent the number of juncture points at that level. All juncture points will be knit together in some regular way by the application of a pattern of arrangement of the structural members characterized by a pattern of lines and triangles connecting juncture levels, where the lines alternate with triangles in some regular way. No arrangement of lines and triangles based upon a series was used to effect top closure of the dome of FIG. 1, but rather all helical spirals begun at the base of the dome have been allowed to proceed to the zenith in uninterrupted manner. Two sets of nine struts or plate edges shown in bold lines follow the steeper helix path from base to zenith proceding from left to right. Two sets of nine struts or plate edges shown in bold lines follow the shallower spiral helix path from base to zenith proceding from right to left. All these bold lines intersect to form the polygon with apices A, B, C, D, and with "midpoint" E. This polygon is bisected by the line AEC in the "horizontal" direction. The "midpoint" of the polygon at E and hence the whole polygon is considered to be at the fourth "horizontal" level from the base as indicated by the numeral 4 at the side of the drawing on the left, where the base is designated number 0 and the zenith is designated number 9.

Figure 2:
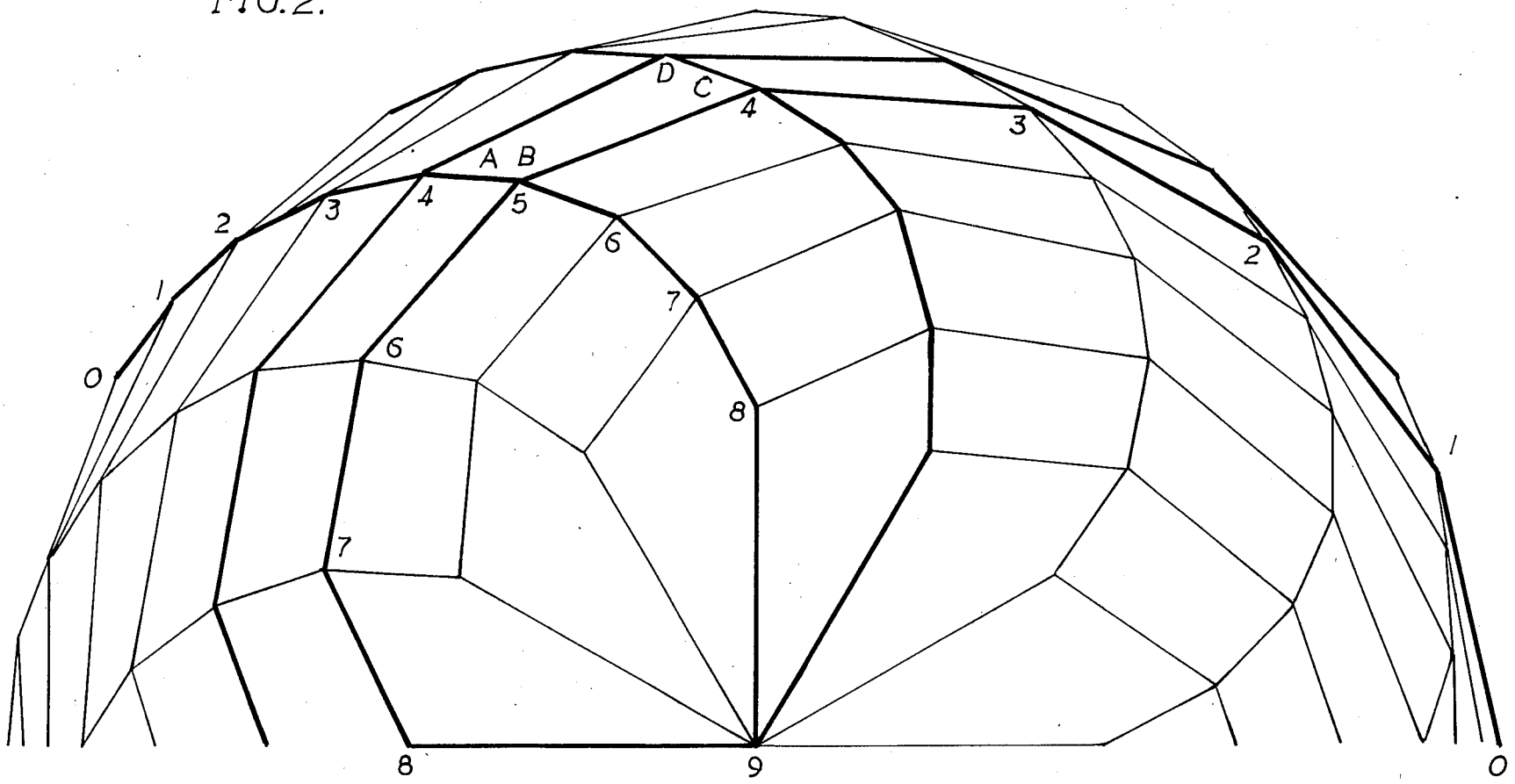
FIG. 2 serves as a top view of one half of the dome and serves as an end view in a second configuration.

A top view of one half of the same dome is shown in FIG. 2. The same bold lines trace the same spiral helix paths and intersections outlining the same polygon at level four. The spiral nature of the helix paths is more easily seen in this top view where only the main helical paths are shown. The spirals are shown moving in the opposite direction to illustrate that the direction may vary.

Figure 3:
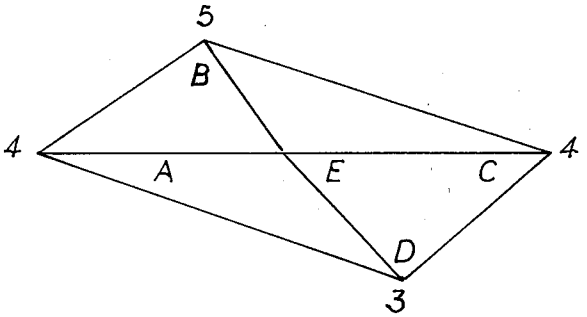
FIG. 3 is an abstraction of one polygon.

FIG. 3 abstracts the polygon designated ABCD in FIG. 1. Point E will be on the same circumscribed sphere containing points A, B, C, and D as well. When the connection is made across the polygon from point A to point C passing through point E a "horizontal" slice is achieved since points A, E, and C will be at level 4, at which level the entire polygon is considered to lie. There are twelve similar polygons at level four and at every other level except the zenith, and the base polygon which is sliced in half "horizontally" leaving only the top half.

Figure 4:
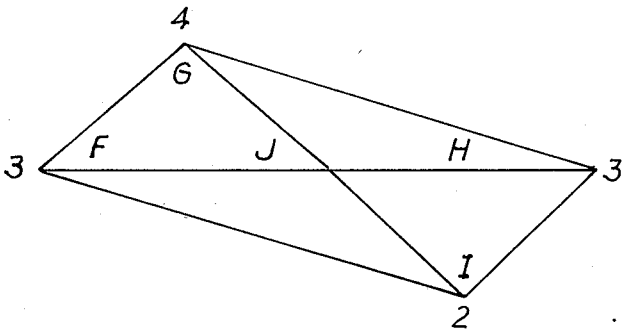
FIG. 4 is an abstraction of a second polygon.
Figure 5:
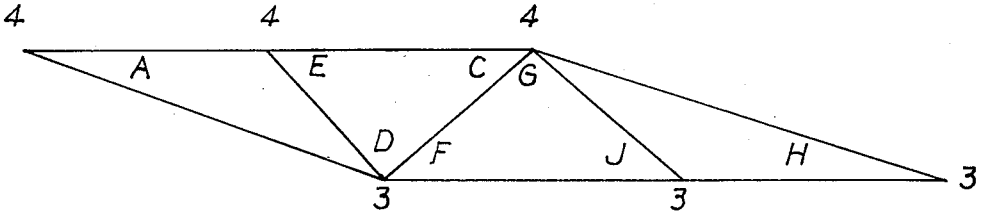
FIG. 5 is a conjunction of half polygons.
Figure 12:
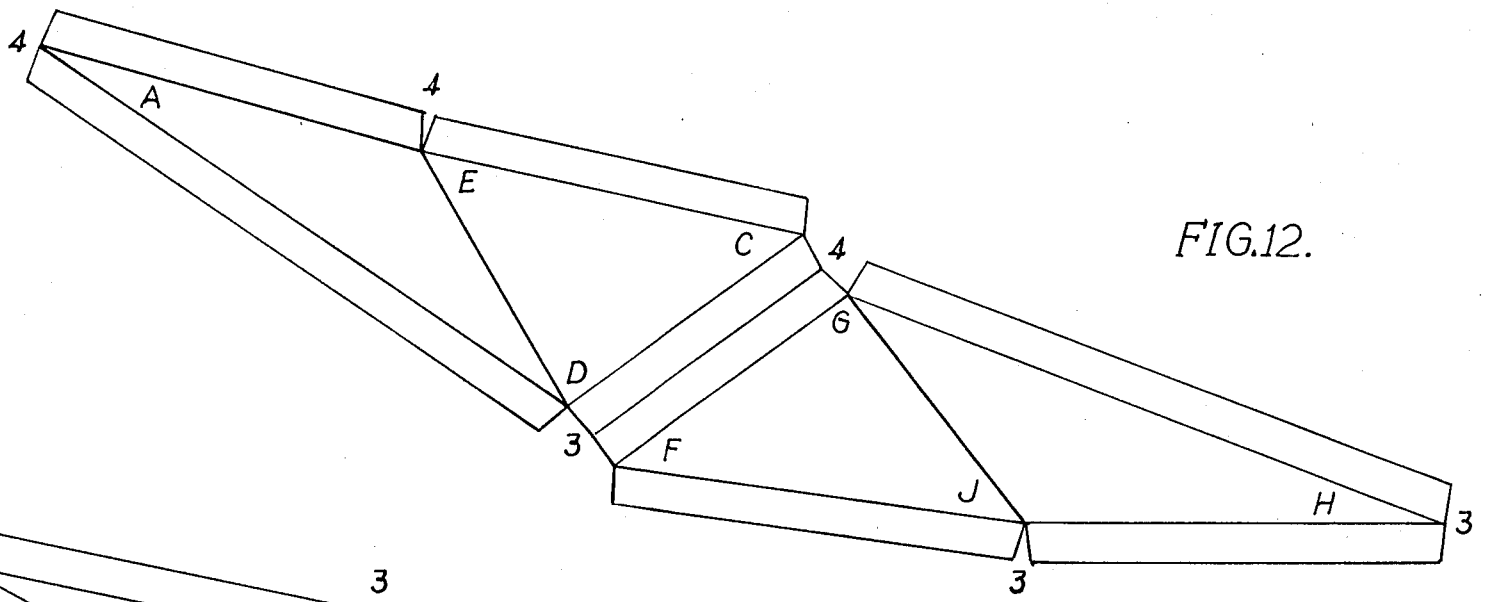
Figure 11:
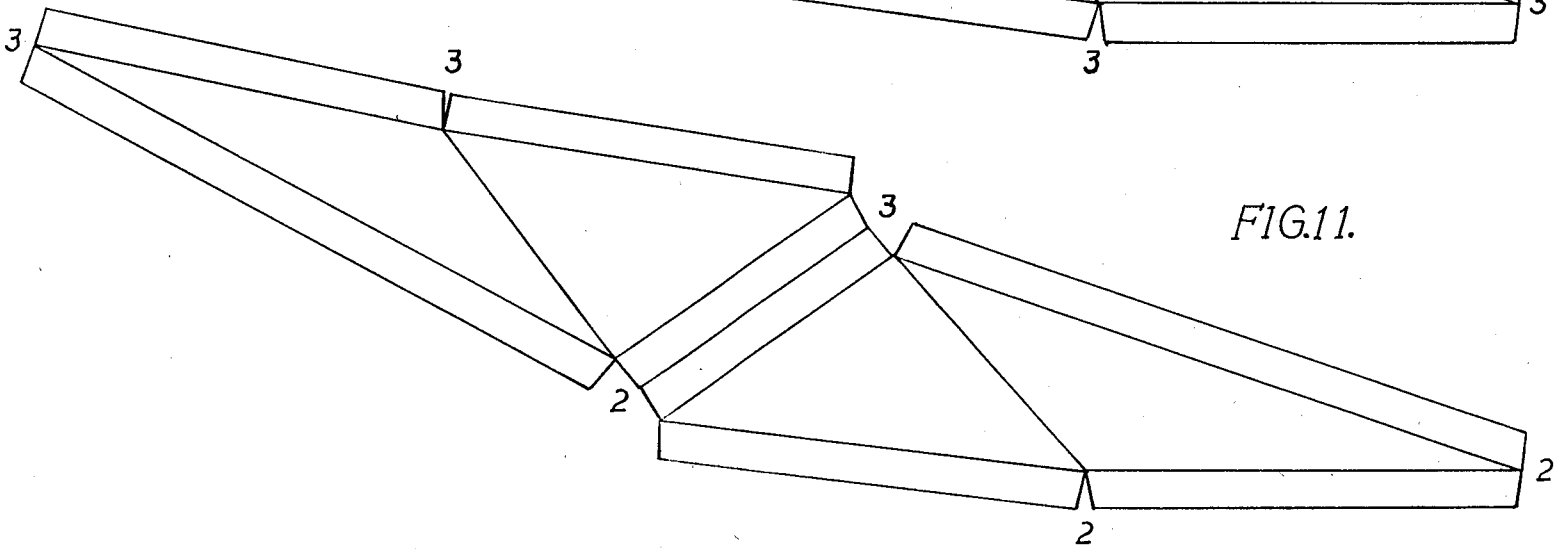
Figure 14:
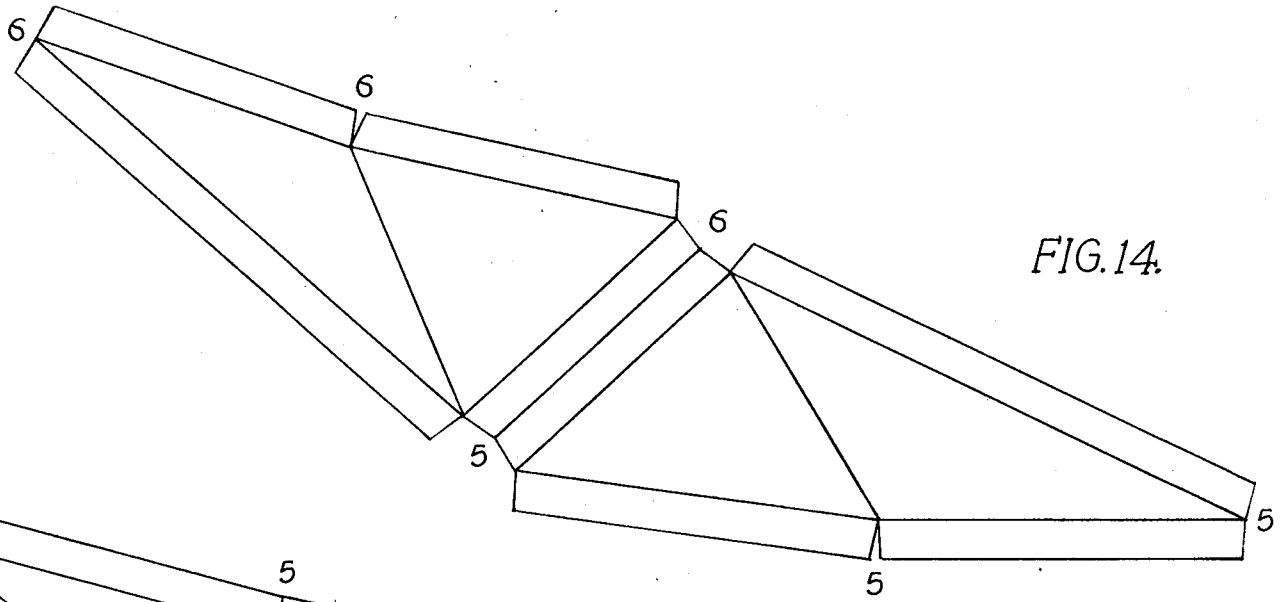
Figure 13:
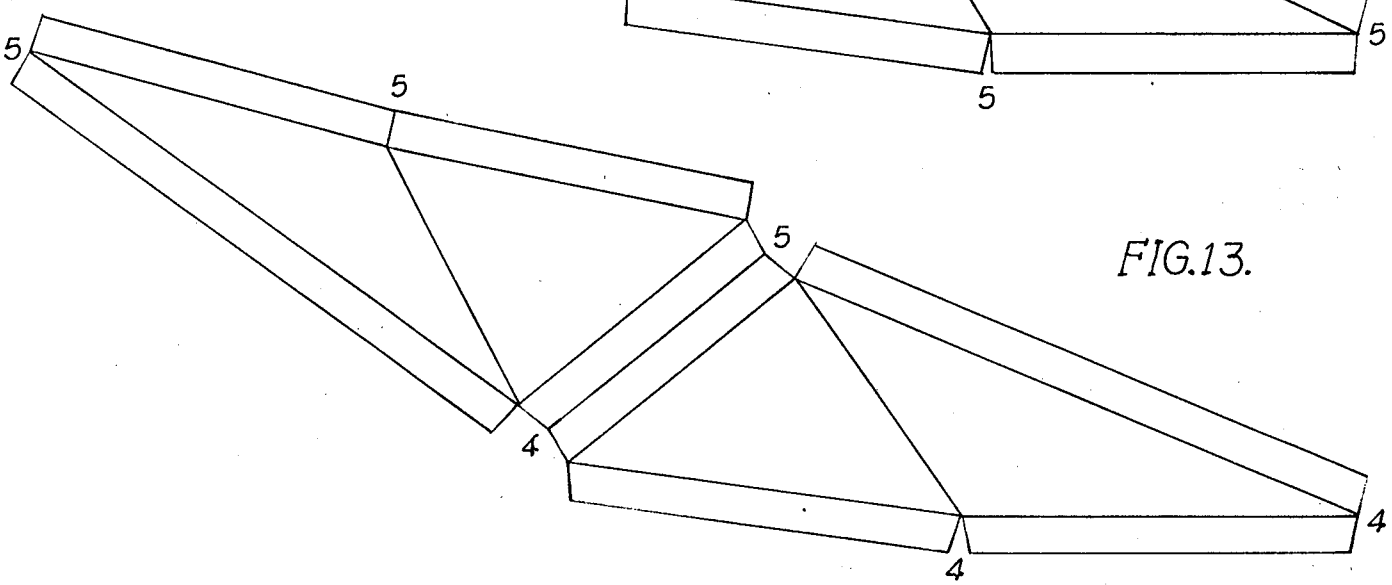
Figure 16:
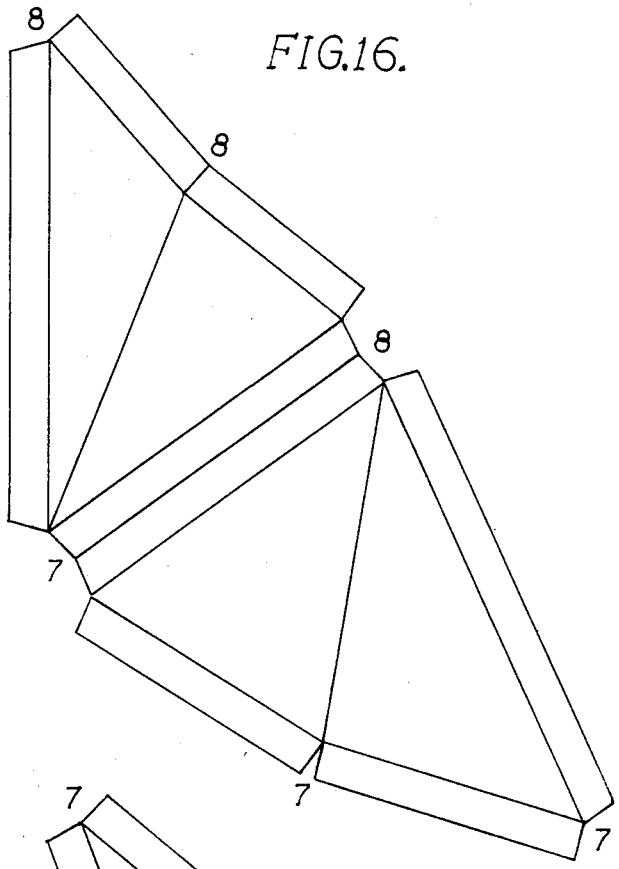
Figure 17:
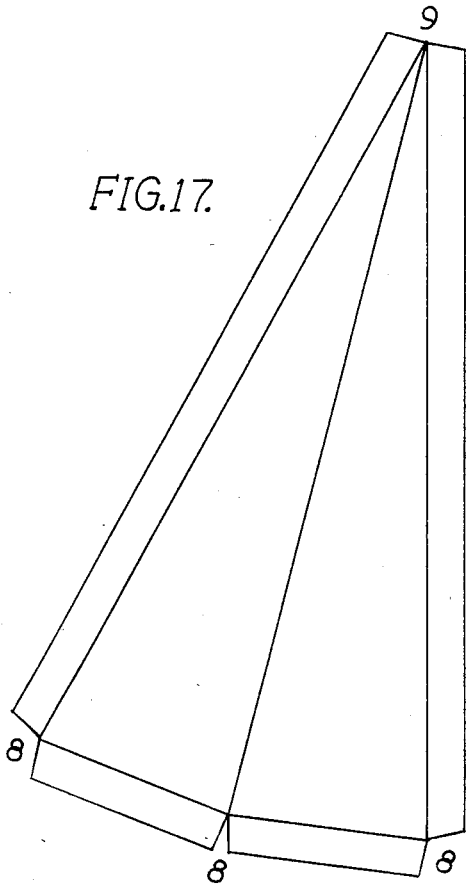
FIG. 17 is a folded plate at the zenith shown in planer layout.
Figure 15:
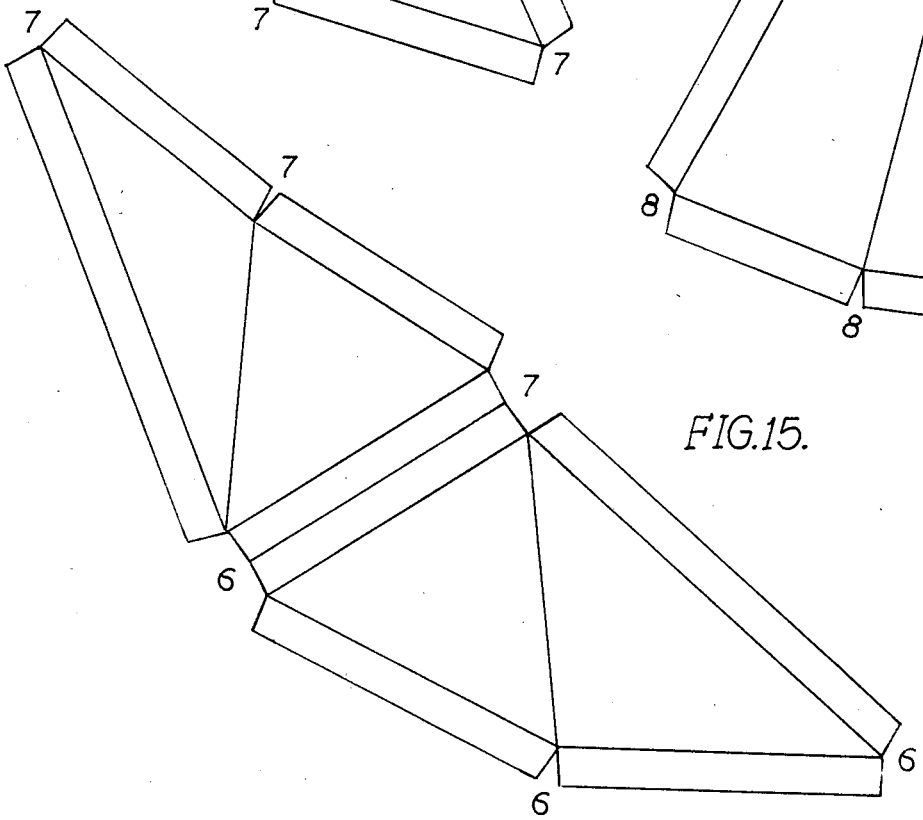

FIG. 4 abstracts the polygon designated FGHI in FIG. 1. Point J is the "midpoint" of the polygon and lies on level 3. The connection FJH is a "horizontal" slice at level 3 with all points being at level 3. FIG. 5 shows the juncture of the polygon shown in FIG. 3 with the upper "half" of the polygon shown in FIG. 4. These two polygonal segments span the distance between level 3 and level 4. Line AD and line GH are identical segments of the two spirals proceding from base to zenith, from right to left, or clockwise as shown in bold lines in FIG. 1. Thus, the segment shown in FIG. 5 also spans the distance between spirals as well as levels. Twelve such segments would completely cover the surface of the dome between level 3 and 4. FIG. 12 corresponds to FIG. 5 except that flanges have been added to facilitate construction. FIG. 12 shows the connection of the two polygonal folded plates being made from point 3 to 4 by abutting the end part of each plate. To complete the juncture each flange would be bent along the line 3 to 4 and folded inward toward the center of the dome along lines DC and FG.

Figure 10:
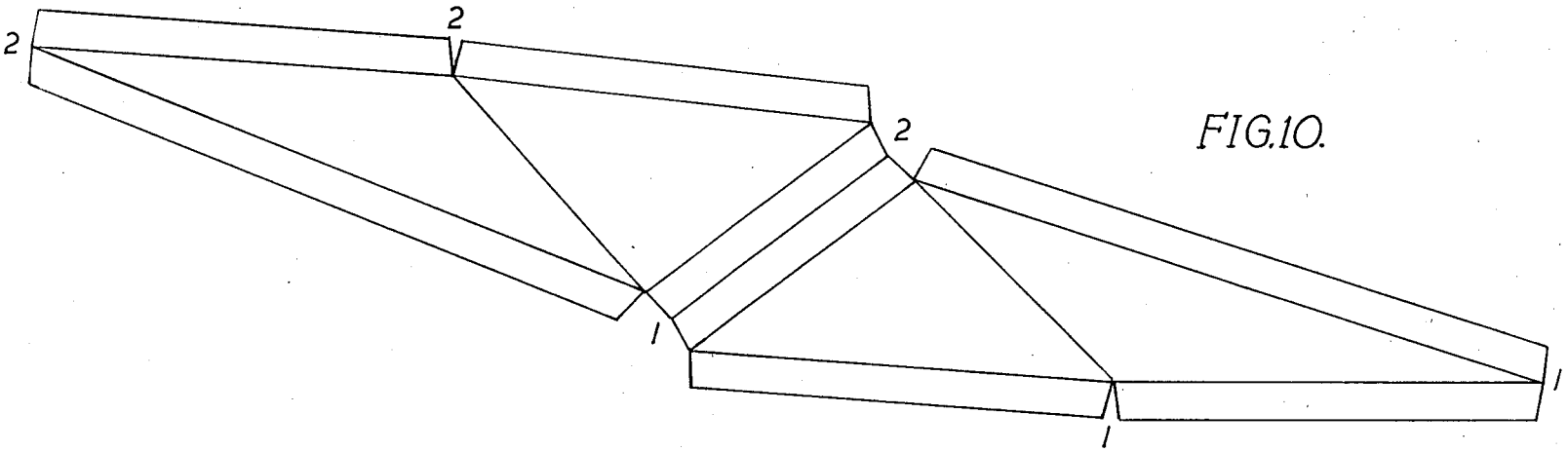
FIGS. 9 through 16 show conjunctions of planar layouts of folded plates.
Figure 9:
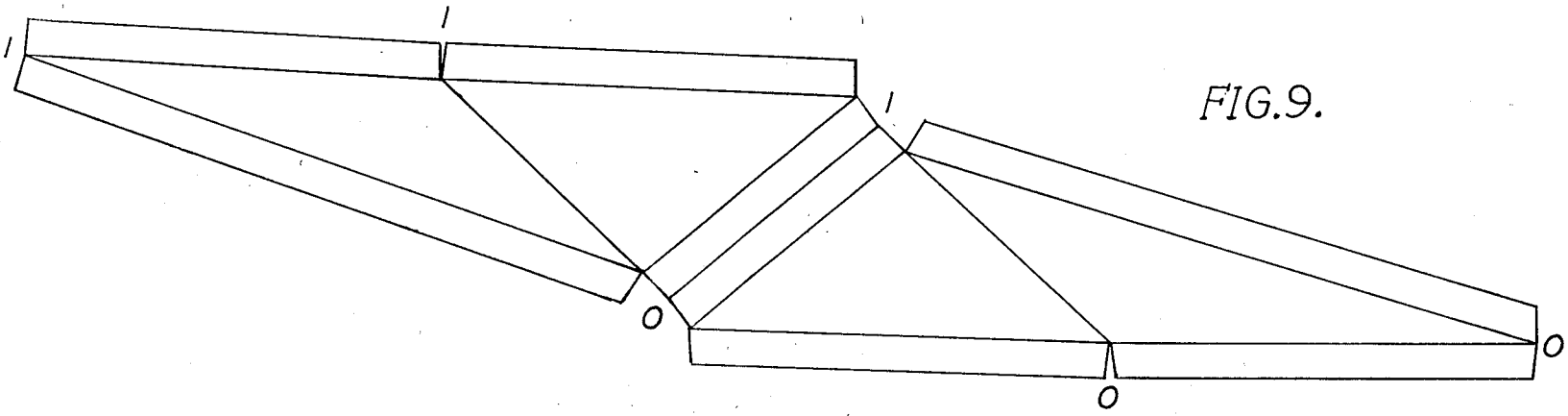

FIG. 9 through FIG. 17 show the plates necessary to build one twelfth part of the dome proceding from base to zenith along the shallow path between the two helix paths from right to left, or clockwise, like those shown with bold lines in FIG. 1. FIG. 9 shows four triangles grouped two triangles at a time into two folded plates with construction flanges all around, and abutted together at the juncture of two construction flanges designated 0 to 1 in the "diagonal" direction from left to right. All apices designated 0 are at the base of the dome and all apices designated 1 are at the first level of construction. Each of the two plates shown in FIG. 9 are creased in the center along the diagonal lines 0 to 1 running diagonally from right to left. The result of creasing the plates is to increase their strength and create plates which are dished out, that is concave to the center of the dome. The construction flanges are angled at the ends so that the end edges point toward the center of the dome when they are folded toward the center. When the dome is assembled by joining all the flanges together, the joints formed by the polygons will be tight. All points designated 1 in FIG. 9 will be joined to all points designated 1 in FIG. 10 to complete the first "course" of eight "courses". Twelve sets of four triangles such as those shown in FIG. 9 when joined together and then joined to the similar flanges in FIG. 10 will complete the first "course", and so on to the top following the path of the spiral having the longer shallower path. Twelve such completed spirals form the entire dome. Construction would proceed by laying each "course" of twelve groups of four triangles around the dome before starting the second "course" represented by the four triangles of FIG. 10. When the triangles of FIG. 10 are joined to the triangles of FIG. 9 twelve times around the dome the second "course" is layed, and so on to the zenith. By laying "courses" the level of the "courses" may be checked as construction proceeds in much the same manner as laying bricks. In this instance the "bricks" are folded plates but the result "course" by "course" is similar to laying brick, except that the wall/roof is spherical like that of an igloo.

Figure 18:
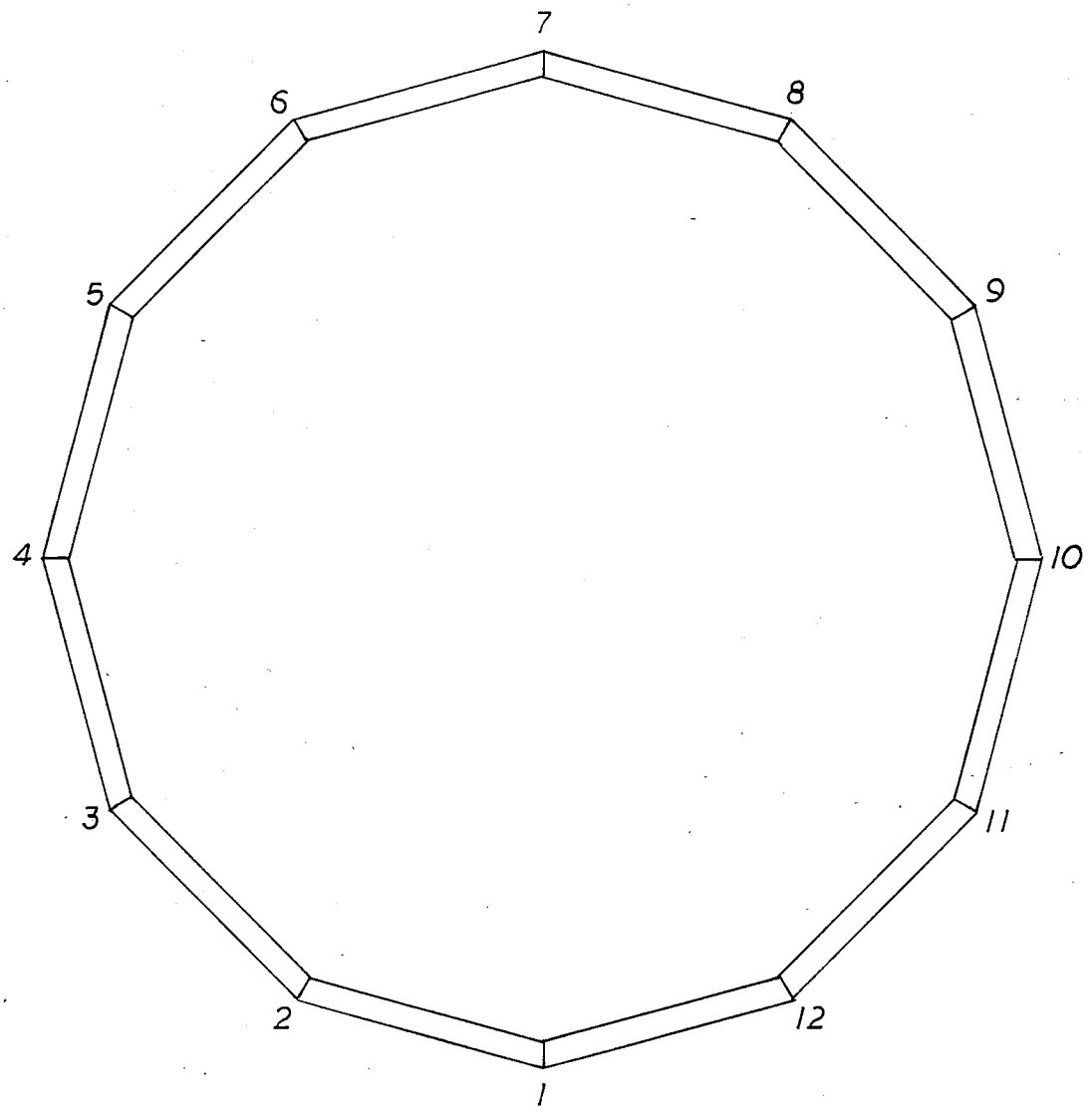
FIG. 18 serves as a top view of the construction jig and a side view of the construction jig in the second configuration.
Figure 19:
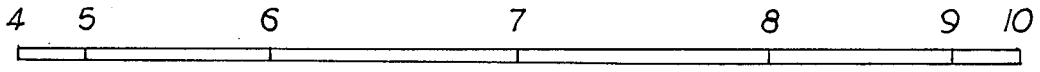
FIG. 19 serves as a side view of the construction jig, or as a top view of the construction jig in the second configuration.
Figure 26:
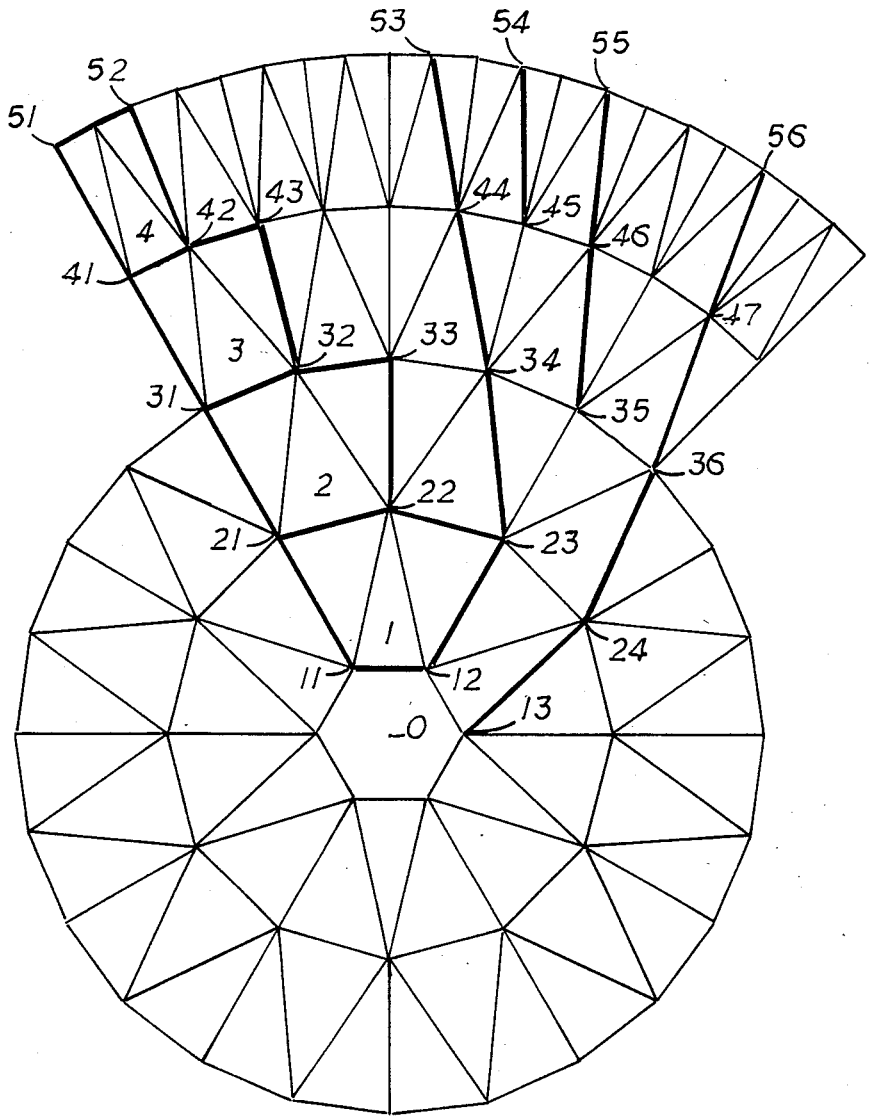
FIGS. 26–28 show additional domes.
Figure 27:
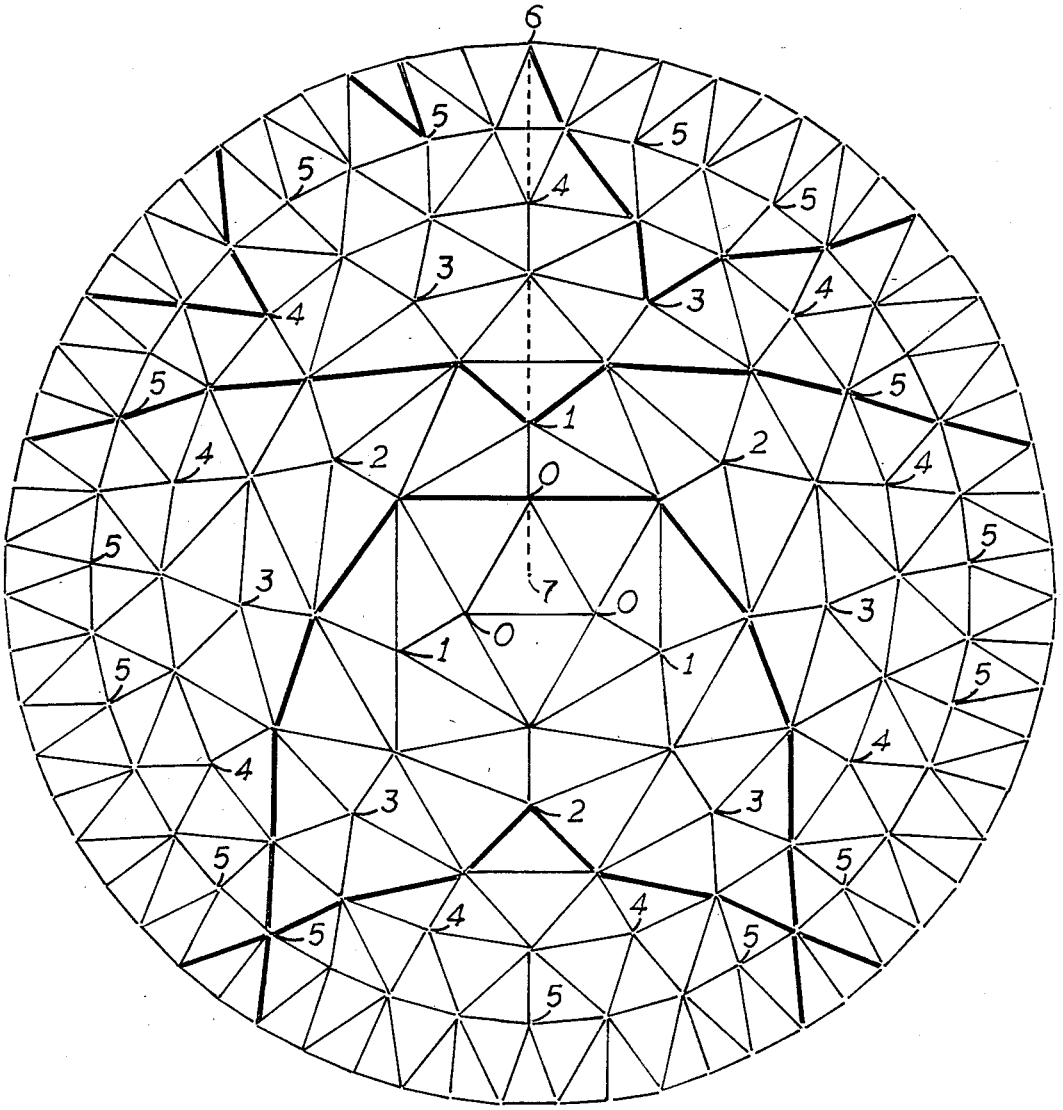
Figure 28:
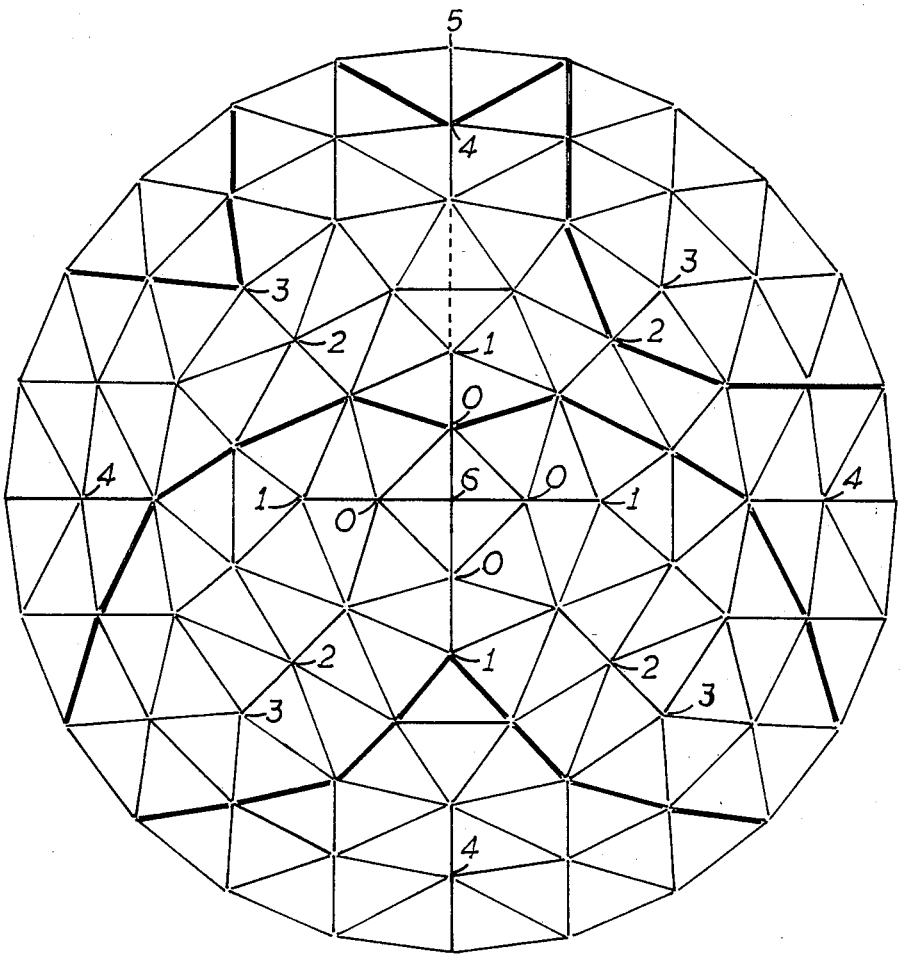

Alternatively, construction could proceed using struts. In this method the "horizontal" struts would be mitered so each mitered joint pointed to the center of the dome at the appropriate height on a plane above the center. At each "course" the "horizontal" struts linked together form a rough circle. Eight such "circles" would provide the jigs for construction at each "course". One such jig is shown as viewed from above in FIG. 18 at level 4 of the dome. FIG. 19 is a side view of the same jig. The jigs will be positioned by a scaffold. Each mitered joint of the roughly circular "courses" becomes the point of juncture for diagonal spiral helix struts. Unlike the "horizontal" struts the diagonal struts may be continuous and not mitered but proceed unbroken from base to zenith. Juncture may be accomplished by weaving the crossing diagonal struts alternatively one on the inside of the other as they proceed over nine juncture points from the base to point 8. Only the zenith might use a hub or king post juncture. The struts at the jig may be secured by wrapping and gluing. Juncture at the top need not require disrupting the strut. It is possible for the strut to follow a spiral continuously over the top and down to the opposite side describing an S shaped path uninterruptedly. Greater strength would result if the material is not cut and joined at the top but is overlaid one strut upon another until wrapped and glued. When continuous struts are used in construction a "tendon" of very flexible material would be used to wrap and secure the struts to the jig. This tendon material would follow a spiral path like that described for the folds in the folded plates from the base to the zenith in a direction exactly opposite to the steeper spiral strut. While the strut material will be slightly flexible, the "tendon" material will be very flexible. The jig may be left in and incorporated in the structure or replaced by a "tendon".

Figure 6:
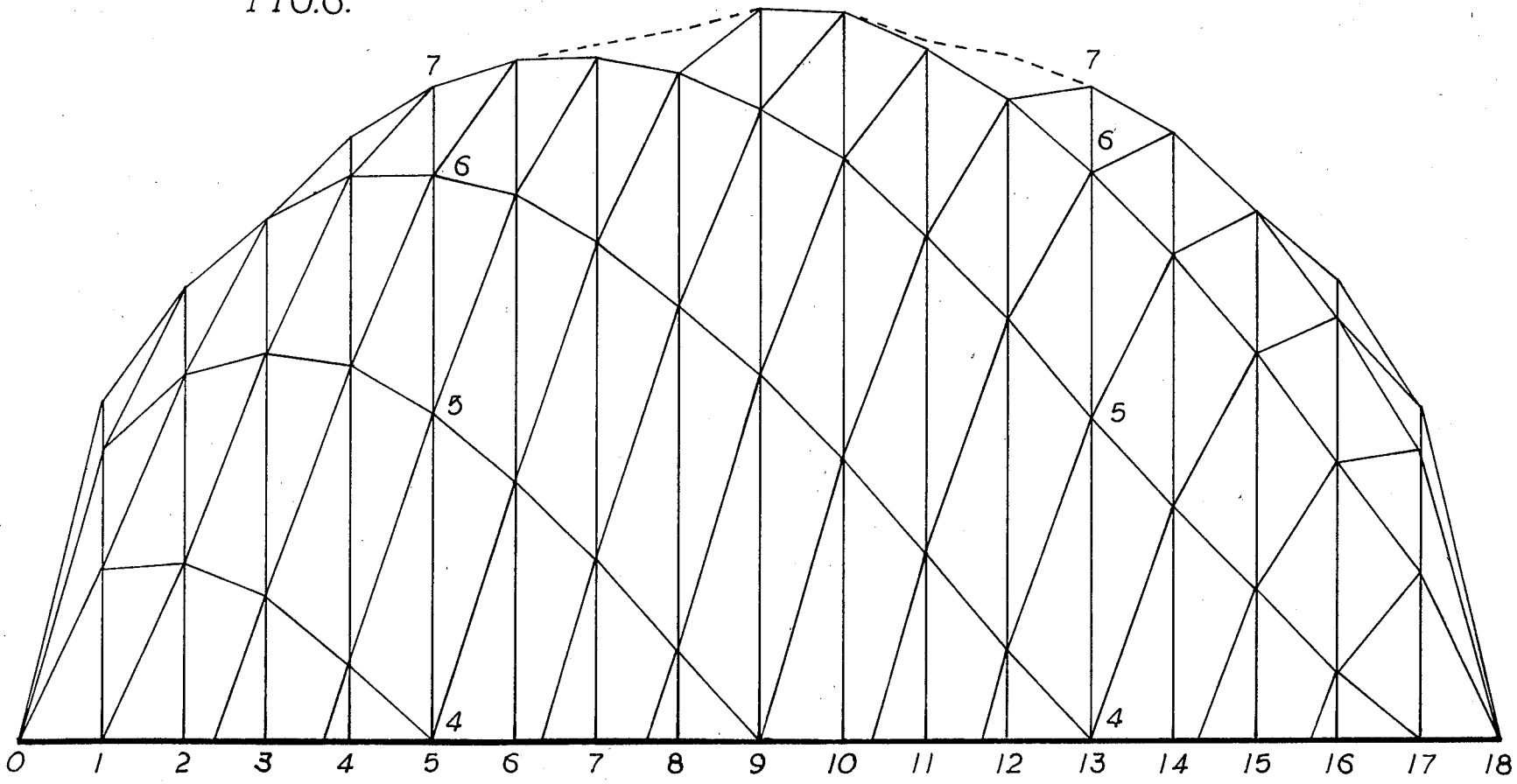
FIG. 6 is a side view of a second configuration of the dome.

The dome shown in FIG. 1 in side view may be built in a second configuration from the same helix formula. In this second configuration the "zenith" is placed at the base rather than the top. The new "zenith" at the base becomes the point of emanation for many of the spirals and is better referred to as "the point of emanation" rather than "zenith" since "zenith" commonly refers to top. Such a point of emanation is matched by another pont of emanation direction across the base for a total of only two. A second configuration of the first dome is shown as an end view in FIG. 2 where point 9 is now at the base as a point of emanation of the spirals. A side view of the second configuration of the dome is shown in FIG. 6 where the two points of emanation are 0 and 18. In this configuration what were "horizontal" jigs now become "vertical" and are represented in end view in FIG. 6 by vertical lines rising from points 1 through 12. As before the eccentric spirals would cross these jigs at specific points determined by the helix formula and may be woven and joined as described for the first dome. The jig shown in FIG. 18 may be taken as a "vertical" jig at points 5 and 13 at the base of FIG. 6 rather than a "horizontal" jig at level 4 of FIG. 1. The base of the jig when considered "vertically" would run across FIG. 18 from point 4 to point 10 and the top of the jig would be at point 7. These points on the jig are shown by numbers 4, 5, 6, and 7 above points 5 and 13 on the base of FIG. 6. FIG. 19 will serve to show the same "vertical" jig from the top with point 4 at the base, point 7 at the top, and point 10 at the base across from point 4.

In this second configuration some "steeper" spirals will emanate from a point on the base and traverse the surface "over the top" to terminate at the base on the other side. Such a "steeper" spiral is shown beginning at point 1 and proceeding upward and to the right to the top of the jig at point 7. From that point it would proceed on the other side to terminate at a point opposite point 9 on the "backside" of the dome. The dashed lines of FIG. 6 show a continuation of the "roofline" of the dome apart from the major eccentric spirals shown.

Figure 7:
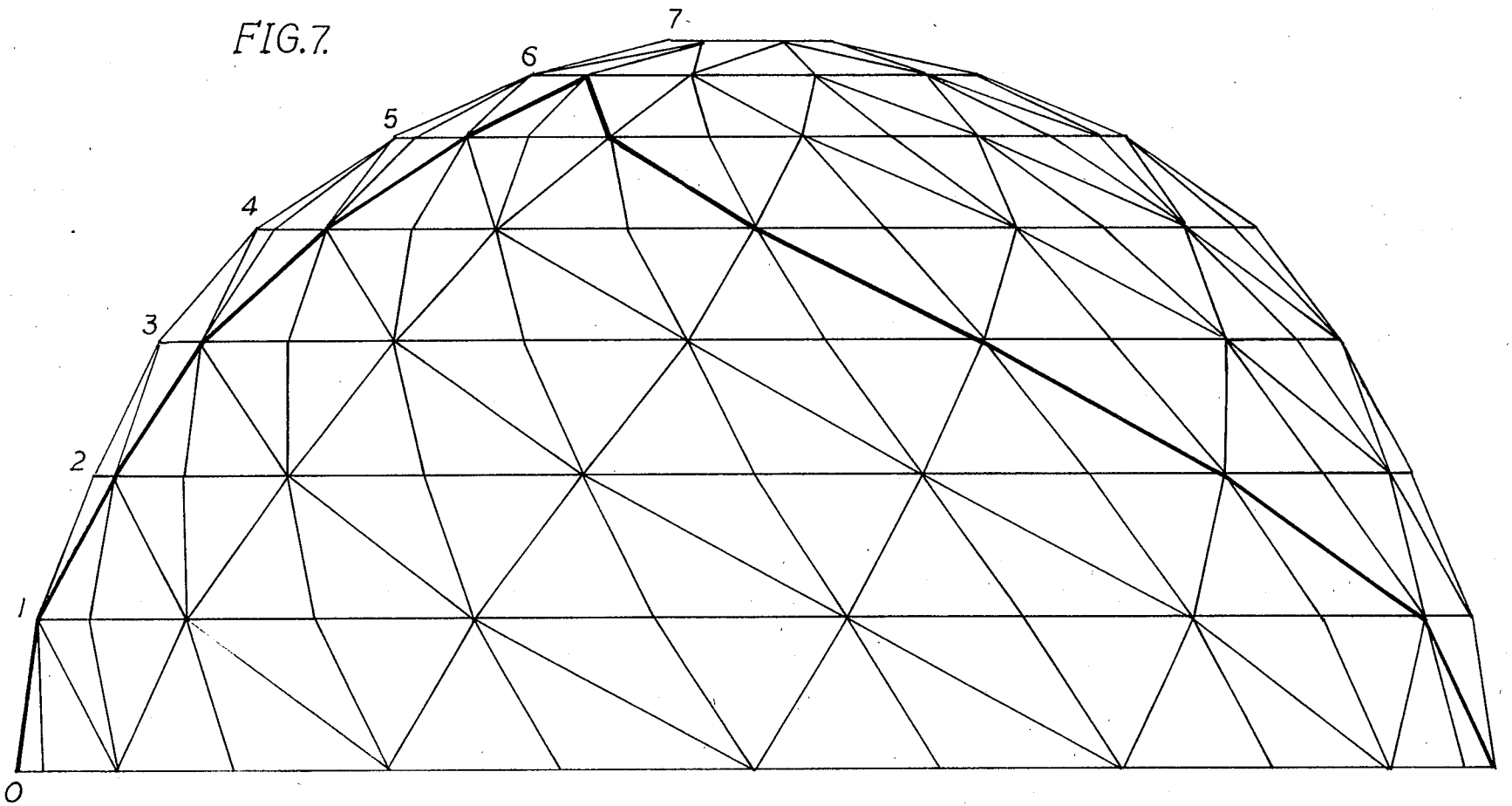
FIG. 7 is a side view of a second dome.
Figure 20:
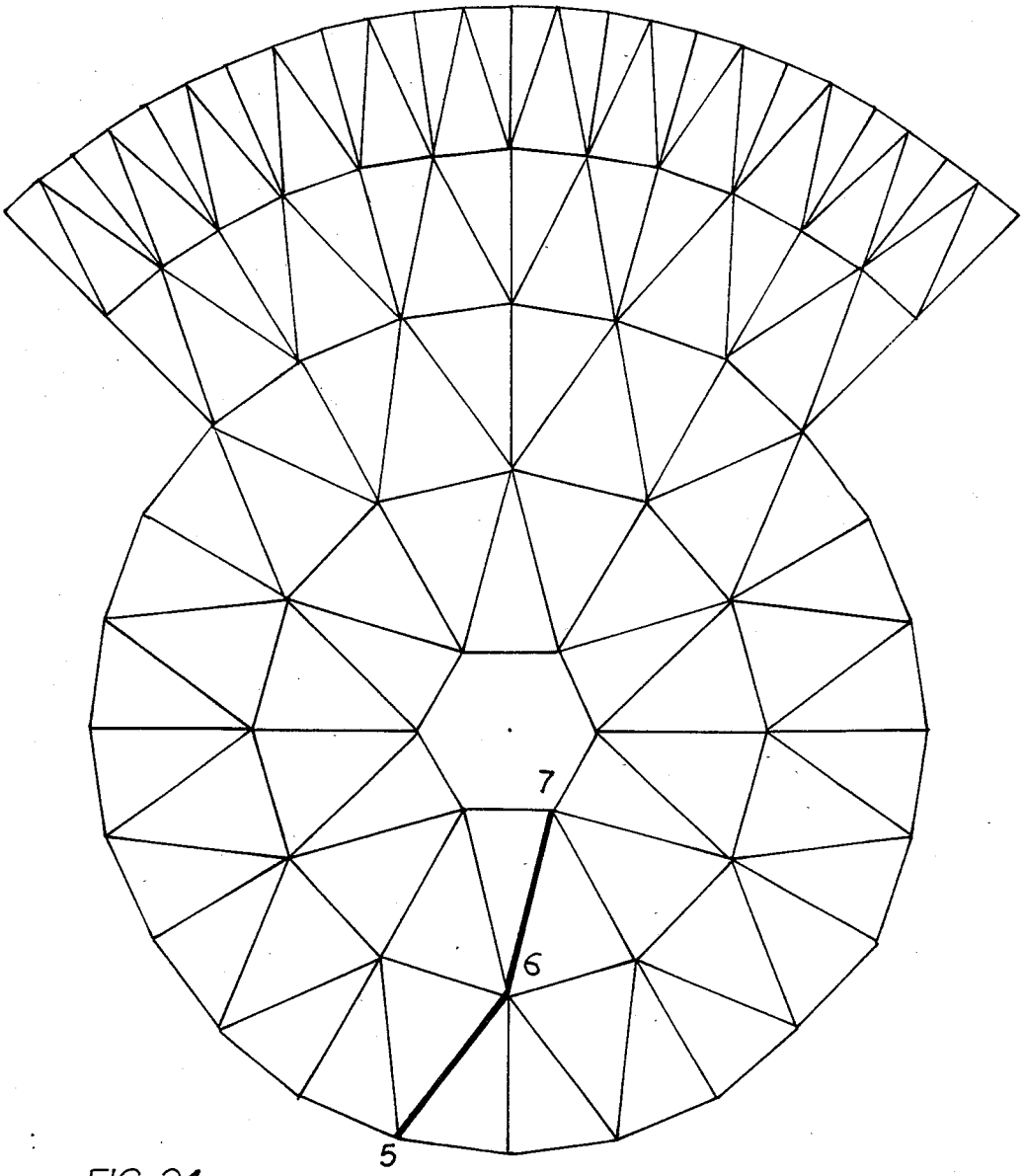
FIG. 20 shows a top view of a top closure with hexagonal top shape.
Figure 21:
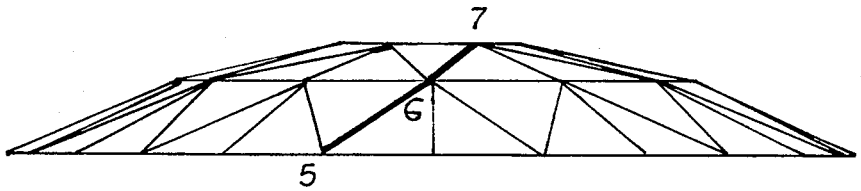
FIG. 21 shows a side view of a top closure with hexagonal top shape.

FIG. 7 shows a second dome with "courses" a constant number of degrees from one another, as reckoned from the center of the dome, rather than a constant distance from one another as shown in FIG. 1 and FIG. 6. Two bold lines show the steeper and shallower paths. The spirals are eccentric in a similar way to the first dome shown in FIG. 1 and proceed from base to zenith through a different number of degrees. This second dome displays another characteristic: the spirals do not traverse as many "courses". The number of "courses" may be variable as the second dome serves to illustrate. The second dome displays another characteristic: a closure at the top containing a progressively smaller number of "horizontal" members beginning with "course" six The means for the top closure is abstracted and shown in greater detail in FIG. 20 as a top view and FIG. 21 as a side view, where the basic top hub shape is the hexagon at "course" 7. There are 24 sides to the polygon at "course" 5, 12 sides to the polygon at "course"6, and 6 sides to the polygon at "course" 7. The series used for deriving this result is: 6, 12, 24, . . . , $\alpha$, where each member is double the previous member, but looking at the matter from the standpoint of approaching the hub the series is used in reverse. Looking at the matter from the hub downward along the surface of the dome, each side of the hub emits a triangle which comes to a point at a point of the polygon below at "course" 6, and each point of the hub emits a line which comes to a point of the polygon below at "course" 6. Then in the next iteration the same process is repeated: each side of the polygon at "course" 6 emits a triangle which comes to a point at a point of the polygon at the base of the top closure at "course" 5 and each point of the polygon at "course" 6 emits a line which proceeds to a point on the polygon below at "course" 5 which is the base of the top closure. The bold lines of FIG. 20 and FIG. 21 trace the path of the helical spiral as it proceeds from a point of the hub top shape designated 7 to a conclusion at point 5 below at "course" 5. A portion of a potential closure proceding further to "course" 3 is shown in the upper part of FIG. 20. This additional portion traces the path of the top closure to "course" 3 and shows the invariant pattern of triangles and lines alternating indefinitely to infinity. The top closure of FIG. 20 and FIG. 21 is a simplification of the one shown in FIG. 7 and FIG. 8 where the angle of rotation of the top closure is the same as that of the shorter strut path and the "courses" of the top closure continue the rotation of the lower "courses" so that "course" 6 rotates with respect to "course" 5 in conformity with the angle of rotation of the shorter strut path and "course" 7 rotates with respect to "course" 6 as well in conformity with the angle of rotation of the shorter strut path.

Figure 22:
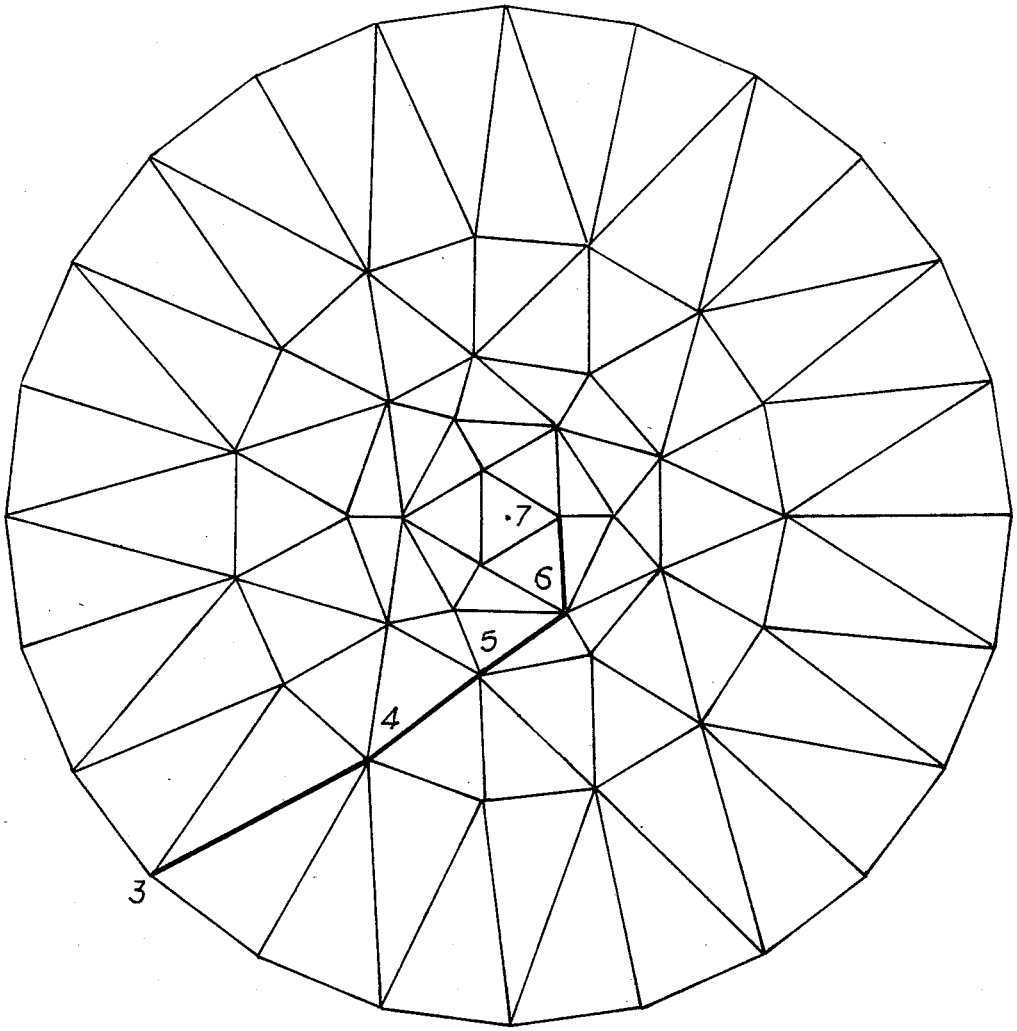
FIG. 22 shows a top view of a parabolic top closure with triangular top shape.
Figure 23:
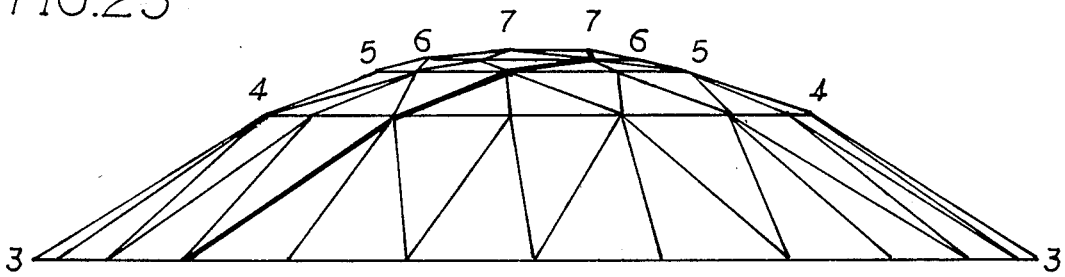
FIG. 23 shows a side view of a parabolic top closure with triangular top shape.

FIG. 22 in top view and FIG. 23 in side view show a different pattern of top closure based on a parabolic curvilinear surface. The helical path derived from the formula: $\phi = a'\theta$ is shown with bold lines traveling from a triangular top hub shape to the base. In this top closure the Fibonacci series: 3, 6, 9, 15, 24, . . . , $\alpha$, is used to determine the number of juncture points at each "course" of juncture and each "course" of juncture is set apart from the other "courses" according to the Fibonacci series: 10°, 20°, 30°, 50°, 80°, . . . , $\alpha$. All these differences are introduced to show the versatility of the procedure in order to demonstrate that it is a general technique and not a particular technique. At all "courses" of this Fibonacci series top closure there will emerge as many triangles from the sides as there are sides to a polygon, but there will be a difference with that emerges from the points: some points will emit lines, but some points will emit triangles. In FIG. 22 this begins to occur at "course" 6 and all subsequent "courses". The pattern of lines and triangles emerging from all points of all polygons at all "courses" is governed by the Fibonacci series: 3, 3, 6, 9, 15, 24, . . . $\alpha$, with lines commencing one iteration earlier than triangles. Also, lines always emerge from the points on the polygons where triangles have come to a point after coming down from the "course" above and triangles always emerge from the points on the polygons where lines come to a point after coming down from the "course" above. It will be seen that this pattern is invariant and proceeds all the way to infinity.

Figure 8:
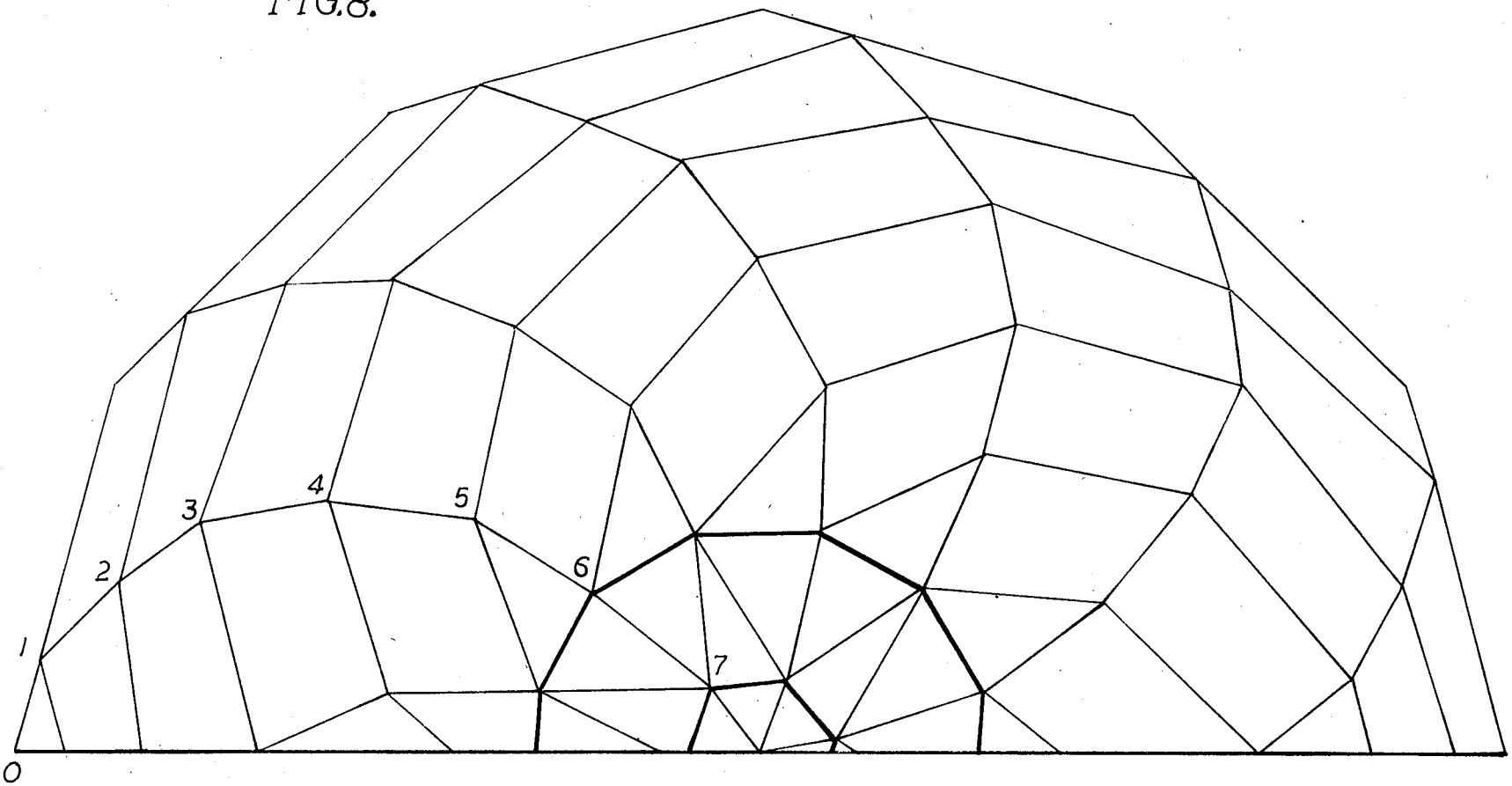
FIG. 8 is a top view of one half of a second dome.
Figure 24:
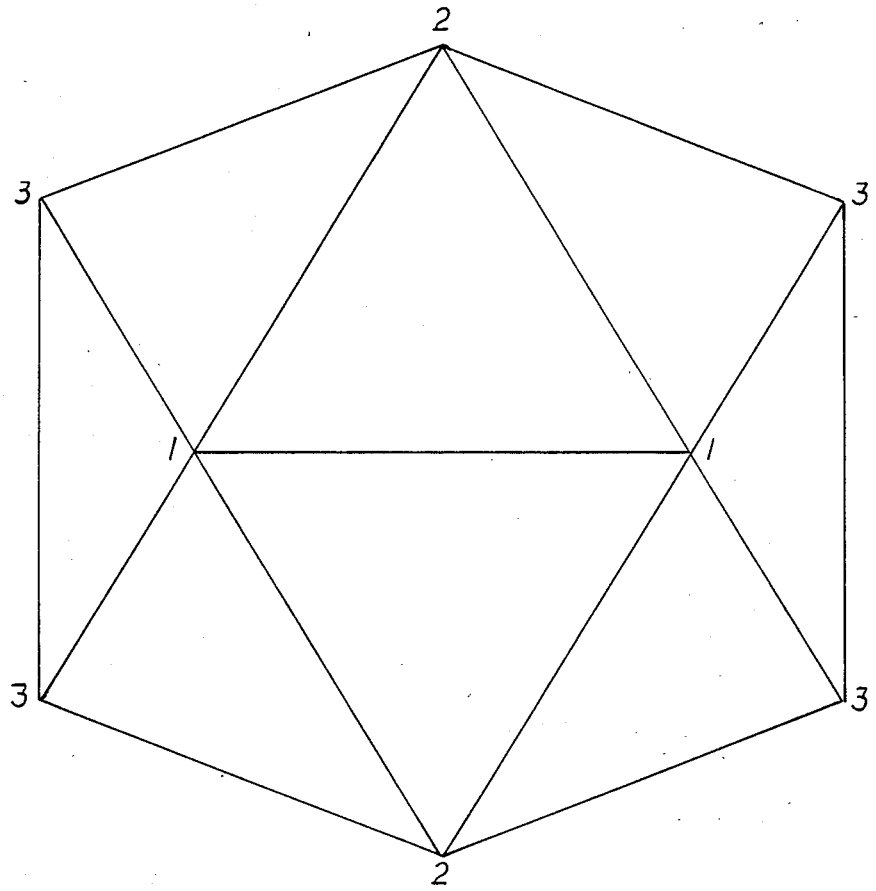
FIG. 24 shows a top view of a top closure with a minimum number of juncture points at the top.
Figure 25:
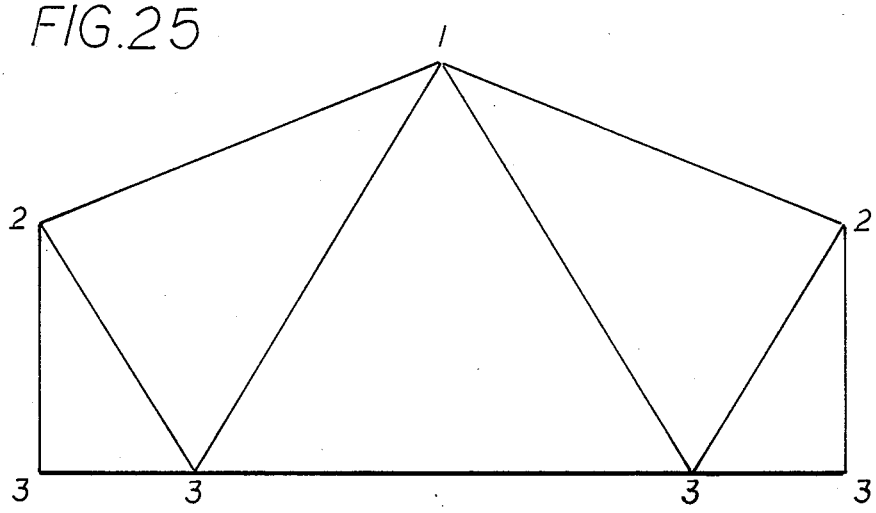
FIG. 25 shows a side view of a top closure with a minimum number of juncture points at the top.

FIGS. 24 and 25 show a spherical top closure in top and side view. This top closure has a minimum member of juncture points at the top which are designated numeral 1 in FIG. 24 and when joined produce a line at the top. The same line is seen edge on in FIG. 25 in side view. These cases are shown for the sake of completeness since they constitute minimal conditions. Anything else is of necessity more complex. This closure is a half sphere and has a vertical connector from "course" 2 to "course" 3 which is seen in FIG. 25 in side view and which is seen edge on in the top view at level 2. The Fibonacci series used in FIG. 24 and 25 is 2, 2, 4, . . . , . The presence of six points at the base forming a hexagon occurs only by reason of truncation. The spiral helix: $Z = a'\theta$ is also used to locate all juncture points in space, were Z, a', $\theta$ are defined in the same way as before, which has one half the number of "horizontal" members as "course" five, and ending with "course" seven which has half as many "horizontal" members as "course" six. By progressively reducing the number of "horizontal" members it is possible to conclude closure easily at the top with a flat six-sided hub, or with six equilateral triangles as shown in FIG. 8. FIG. 8 displays a top view of one half of this dome showing the major helical paths with the reduced number of "horizontal" members shown with bold lines at "course" 6 and 7. This second dome may be built like the first dome with folded plates, struts, with continuous material following the spiral paths over jigs similar to those in FIG. 18 and FIG. 19, where the jigs are "horizontal".

I claim:

1. A geodesic dome structure that may be mapped entirely with triangles from zenith to base containing, a. a zenith, defined as the single point directly above the center of the dome and at the top of the axis of revolution and, b. a top shape, where top shape is defined as points of juncture at the next level of juncture below the zenith, where the points of juncture are arranged horizontally and parallel to the base and equidistant from those on either side, and where the said top shape may include two juncture points connected by a line segment; three juncture points connected by line segments to form a triangle; four and more than four juncture points connected by line segments to form a polygon and where the number of juncture points of the said top shape is the first entry number of a series of numbers called the multiplicative series: $n_j = kn_i$ where $n_j$ is the second number of the series; $n_i$ is the entry number of the series and k is some constant, each number of the series following the entry number is calculated by multiplying the prior number by the constant 2, and where the points of juncture of the top shape correspond to the first entry number of the series and may be connected to the zenith by line segments, and where all adjacent pairs of points of the top shape are connected by two line segments to the point on the shape below, between, and equidistant from the pair above, to form a triangle where the said triangle will be an extension of the top shape, and, c. levels of juncture established from the formula: $Z=r'\cos\phi$, where Z is the height of levels of juncture; $\phi$ is the angle of decline of a vector from its initial position coterminus with the axis of rotation; r' is a parameter and not a constant and which may taken on a set of values for the radius vector from the origin of the dome to the surface of the dome, and where a radius vector from the origin to the surface of the dome will constrain the dome to conform with whatever curvilinear shape is desired, and, d. primary juncture paths defined as points of juncture emanating from the zenith and proceding to the base where a line segment will initiate the path coterminus with the great circle and where the line segment will connect the top shape to the shape below and where additional line segments will repeat the process following the great circle all the way to the base, and, e. shapes below the top shape where shapes are defined as points of juncture at the same level of juncture and arranged horizontally in a plane parallel to the base and equidistant from points on either side, and where the second shape will have the same number of juncture points at the second number of the series and where successive shapes below will have the same number of juncture points as their respective number in the multiplicative series and where all points of juncture of the shapes will be equidistant from those on each side and emanate from the primary juncture path and may be connected horizontally with line segments to form polygons and where all points of the shapes may be joined by line segments to points above and below in higher and lower shapes, and, f. secondary juncture paths, which emanate from points of juncture on the shapes and follow a great circle all the way to the base where line segments coterminus with the great circle connect all lower shapes to the shape from which the secondary juncture path emanates, and where each of the new secondary juncture paths is between a pair of the existing juncture paths, and, g. primary spirals emanating from the points of the top shape and secondary spirals emanating from the juncture points on the shapes below and where the said spirals are clockwise and counter clockwise and where the paths of the spirals may be described by the formula for the spiral helix: $\phi=a'\theta$, where $\phi$ is the angle of decline of a vector as it moves away from its initial position coterminus with the axis of revolution of the dome; $\theta$ is the angle of rotation of a vector perpendicular to the axis of revolution; a' is a parameter and not a constant, and where a radius vector from the origin to the surface of the dome will constrain the spirals to conform to whatever curvilinear shape is desired, and where segments will complete the mapping of the structure by proceding to connect the juncture points along the spirals.

2. The structure of claim 1 wherein a five sided polygon will be defined as lying between two of the aforesaid juncture paths and two of the aforesaid juncture levels and where the said five sided polygon will contain, a. two juncture ppoints above on the higher of the two juncture levels and where a line segment will connect the two juncture points spanning the distance from one juncture path to another, and where the said line segment will form the top leg of an inscribed triangle and where a line segment will proceed from each juncture point to a juncture point below following each of the juncture paths at the sides of the said polygon and, b. three juncture points on the lower of the two juncture levels where the center juncture point of the three is equidistant from the juncture points on either side of it and connected to them by line segments and where the center juncture point of the three will also be connected by line segments to the two juncture points above to form the other two legs of the inscribed triangle, and, c. the set of all five sided polygons where that set will completely map the surface of the structure from the top shape down to the base.

3. A geodesic dome structure which may be entirely mapped by triangles from zenith to base containing, a. a zenith defined as the single point above the center of the dome and at the top of the axis of revolution and, b. a top shape where top shape is defined as points of juncture at the next level of juncture below the zenith where the points of juncture are arranged horizontally and parallel to the base and equidistant from those on either side, and where the said top shape may include two juncture points connected by a line segment; three juncture points connected by line segments to form a triangle; four and more than four juncture points connected by line segments to form a polygon, and where the number of juncture points of the said top shape is the first entry number of a series of numbers called the Fibonacci series: $F_k=F_j+F_i$, where $F_k$ is the third number of the series; $F_j$ is the second number of the series called the second entry number, and where the second entry number of the series may be double the first entry number; $F_i$ is the first entry number of the series and may be any number two and greater than two, where each number of the series following the two entry numbers is calculated by adding the prior two numbers, and where the points of juncture of the top shape correspond to the first entry number of the series and may be connected to the zenith by line segments, and where all adjacent pairs of points of the top shape are connected by line segments to a point on the shape, below, between, and equidistant from the pair above, to form a triangle, and where the said triangles will be extensions of the top shape and, c. levels of juncture established from the formula: $Z=r'\cos\phi$, where Z is the height of levels of juncture; $\phi$ is the angle of decline of a vector from its initial position coterminus with the axis of revolution; r' is a parameter and not a c onstant and which may take on a set of values for the radius vector from the origin of the dome to the surface of the dome, and where a radius vector from the origin to the surface of the dome will constrain the dome to conform with whatever curvilinear shape is desired and, d. primary juncture paths defined as points of juncture emanating from points of the top shape and proceding on and about a great circle emanating from the zenith and proceding to the base where a line segment will initiate the path coterminus with the great circle to the shape below and where the point on the shape below becomes the center point of a group of seven points forming a stellation point for six points surrounding it which are connected to it by line segments and where line segments around the perimeter connect all perimeter points to form a six sided polygon spanning four juncture levels, with one point at the top of the polygon and with three juncture points at the next level with the stellation point included in the center of the group of three juncture points and equidistant from the juncture points on either side and with two juncture points at the next level of juncture and equidistant from the great circle and with one juncture point at the bottom of the six sided polygon and on the great circle and, e. shapes below the top shape where shapes are defined as points of juncture at the same level of juncture and arranged horizontally in a plane parallel to the base and equidistant from points on either side, and where the second shape will have the same number of juncture points as the second entry number of the said Fibonacci series and where the second shape will be below the top shape, and where the third shape will have a number of juncture points calculated from the Fibonacci series and where the third shape will be below the second shape and where all other shapes following the third shape will have a number of juncture points calculated from the Fibonacci series and be at successively lower levels of juncture and where all points of juncture of the shapes will be equidistant from those on each side and emanate from the primary juncture path and may be connected horizontally with line segments to form polygons and where all points of juncture of the shapes may be joined to points above and below in higher and lower shapes and, f. secondary juncture paths which emanate from the exterior juncture points of the second level of juncture of each of the six sided polygons and on either side of the stellation points and where said secondary juncture paths form the locus of additional six sided polygons below and enable the entire surface of the dome to be mapped with six sided polygons of the same sort as the first primary path polygons all the way to the base and where the number of polygons at each level of juncture will follow a Fibonacci series and, g. primary spirals emanating from the points of the top shape and secondary spirals emanating from the stellation points of the six sided polygons and where the said spirals follow clockwise and counter clockwise paths to the base where the paths of the said spirals form the external boundaries of the six sided polygons below and where the paths are described by the formula for the spiral helix: $\phi = a'\theta$, where $\phi$ is the angle of decline of a vector as it moves away from its initial position coterminus with the axis of revolution of the dome; $\theta$ is the angle of rotation of a vector perpendicular to the axis of revolution; a' is a parameter and not a constant, and where a radius vector from the origin will constrain the spirals to conform to whatever curvilinear shape is desired and, h. the set of all spirals that will completely map the surface of the dome from the top shape to the base, and where all juncture points of all spirals are connected to juncture points on the said spirals above and below by line segments.

4. The structure of claim 3 wherein the stellation point and all the six segments connecting it to the peripheral juncture points of the aforesaid six sided polygon are removed and replaced with an inscribed triangle with single apice at the top and two at the sides of the polygon at the third level of juncture and where all apices of the triangle are connected by line segments.

5. A geodesic dome structure entirely mapped by triangles from zenith to base containing, a. a zenith defined as the single point above the center of the dome and at the top of the axis of revolution and, b. a top shape defined by points of juncture at the next lower level of juncture arranged equidistant and horizontal in a plane parallel to the base and where the said top shape may include two juncture points connected by a line segment; three juncture points connected by three line segments to form a triangle; four and more than four juncture points connected by line segments to form a polygon, and where the number of juncture points of the said top shape is the first entry number of the series: $n_j = n_i + k$, where $n_j$ is the next number of the series to be found; $n_i$ is the first entry number of the series; k is some constant which may be selected to be the same value as $n_i$, where each number of the series is calculated by adding the constant to the prior number and, c. levels of juncture established from the formula: $Z = r'\cos\phi$, where Z is the height of the levels of juncture; $\phi$ is the angle of decline of a vector as it moves away from its initial position coterminus with the axis of revolution; r' is a parameter and not a constant where the said parameter may take on a set of values for the radius vector from the origin of the dome to the surface of the dome and where a radius vector from the origin to the surface of the dome will constrain the shape of the dome according to whatever curvilinear shape is desired;

d. a primary juncture path with points of juncture on and about a great circle from the zenith to the base and having a pattern of lines spanning three juncture levels followed by diamonds spanning three juncture levels, where the diamonds have one point at the top on the great circle and two points at the next lower juncture level and equidistant from the great circle and on each side of the great circle and joined horizontally by a line segment, and a juncture point at the bottom of the diamond at the next lower juncture level, and, where the perimeter points of the diamond shape are joined by line segments, and, e. shapes below the top shape at successively lower levels of juncture where the number of juncture points in each shape corresponds to the successive numbers of the aforesaid series and where the juncture points are equidistant from those on either side and in a plane parallel to the base, and emanating from the primary path, and, joined by line segments to form polygons and where all points of juncture of the shapes are connected to points of juncture on shapes above and below and, f. primary spirals emanating from the juncture points of the top shape and secondary spirals emanating from the other juncture points of the other shapes where said juncture points are not traversed by a prior spiral and where all spirals may be described by the formula for the spiral helix: $\phi = a'\theta$, where $\phi$ is the angle of decline of a vector coterminus with the axis of revolution as it declines toward the base; $\theta$ is the angle of rotation of a vector perpendicular to the axis of revolution as the said vector rotates away from its initial position; a′ is a parameter and not a constant, and where a vector from the origin of the dome to the surface of the dome will constrain the spirals to conform to whatever curvilinear shape is desired, and where line segments will join all consecutive juncture points of the spirals and, g. the set of all spirals which will completely map the surface of the dome from the top shape all the way to the base and where all the juncture points of all the spirals are connected to juncture points on the spirals above and below.

* * * * *